US005265941A

United States Patent [19]

Marteney

[11] Patent Number: 5,265,941

[45] Date of Patent: Nov. 30, 1993

[54] UNDERGROUND MINING SYSTEM AND METHOD FOR DEVELOPING LONGWALL PANEL

[75] Inventor: Larry G. Marteney, Bridgeport, W. Va.

[73] Assignee: Tamrock World Corporation, N.V., Curacao, Netherlands Antilles

[21] Appl. No.: 932,776

[22] Filed: Aug. 20, 1992

[51] Int. Cl.[5] ..... E21F 1/14; E21C 41/00

[52] U.S. Cl. ..... 299/12; 299/19; 454/168

[58] Field of Search ..... 299/12, 19, 64, 67, 299/33; 454/168, 169, 170

[56] References Cited

U.S. PATENT DOCUMENTS

| | | | |
|---|---|---|---|
| 903,492 | 11/1908 | McDonough | 454/169 X |
| 3,111,306 | 11/1963 | Love et al. | 299/11 |
| 3,997,216 | 12/1976 | Russell | 299/19 X |
| 4,007,966 | 2/1977 | Wenneborg | 299/12 X |
| 4,157,204 | 6/1979 | Kissell et al. | 299/64 |
| 4,380,353 | 4/1983 | Campbell et al. | 299/12 |
| 4,440,070 | 4/1984 | Baker et al. | 454/170 |
| 4,607,568 | 8/1986 | Hill et al. | 454/170 |
| 4,953,914 | 9/1990 | LeBegue | 299/33 X |

FOREIGN PATENT DOCUMENTS

| | | | |
|---|---|---|---|
| 696163 | 11/1979 | U.S.S.R. | 454/168 |

*Primary Examiner*—David J. Bagnell
*Attorney, Agent, or Firm*—Stanley J. Price, Jr.

[57] ABSTRACT

An entry system for a longwall panel for the mining of coal and the like by a shearer-type cutter includes a single entryway developed by a boring type mining machine. Intake air and return air passageways are formed in the entryway by a mine stopping between the mine roof and floor to permit circulation of the air within the entryway as it is being developed. One of the passageways conveys the intake air into the entryway and the return air passageway serves to direct the dust laden air away from the mine face and receives conveyor apparatus for transporting the dislodged material out of the mine.

14 Claims, 1 Drawing Sheet

UNDERGROUND MINING SYSTEM AND METHOD FOR DEVELOPING LONGWALL PANEL

BACKGROUND OF THE INVENTION

1. Field of the Invention

This invention relates to an underground mining system, and more particularly, to a method of mining for developing a longwall panel.

2. Description of the Prior Art

In underground mining, it is well known to continuously dislodge material from a mine face by operation of a continuous mining machine which includes a cutter drum assembly mounted on the front end of the mining machine. The dislodged material is conveyed rearwardly of the cutter drum on the mining machine by a longitudinally extending conveyor. The continuous mining machine continuously advances as material is dislodged from the mine face forming an entry or tunnel in the material seam.

U.S. Pat. No. 3,111,306 discloses a method of mining using a continuous mining machine. A series of substantially parallel entries are driven into the rock formation. A series of substantially parallel rooms are driven at angles to the entries to divide the area to be extracted into tiers of pillars. Then the tunnels are driven in a substantially straight line through the tiers of pillars. After a pillar has been mined, the mined tunnels are caved to relieve pressure on the formation so that the former entries and rooms are lost in the caved area.

In longwall mining parallel, spaced entries are driven into the seam of material to be mined. A mine face is formed between and perpendicular to the spaced apart entries. A shearer-type cutting machine traverses the mine face between the entries. Additional parallel entries are driven to the working face to ventilate the face and provide access thereto for the movement of operating personnel, equipment, supplies, etc. The mined material is transferred to a conveyor that runs parallel to the mine face. The mined material is conveyed laterally to one of the entries and then conveyed or suitably transported therefrom out of the mine. The shearer repeatedly traverses the length of the mine face to dislodge the panel of material to be mined between the mine entries defining the panel.

The continuous mining and longwall mining operations require ventilation of the entries for the supply of air flow to the working face. One approach to face ventilation is the use of a line curtain in an entry, as disclosed in U.S. Pat. No. 4,157,204. A line curtain extends parallel to and is spaced from the walls of an entry, dividing the entry into two parallel passageways. The curtain is mounted between the mine floor and roof. The mining machine is positioned on one side of the curtain. Air flow is directed to the entry to the working face in the passageway where the mining machine is operating. From the working face, the return air is directed to the passageway on the other side of line curtain. In this manner, a continuous flow of air is generated toward and away from the working face.

While it is known to ventilate mine entryways as above-described, there is need in a longwall mining system for efficiently ventilating the working face by the conveyance of air flow to and from the face through the entries driven to the face. However, the entries must also be accessible for the transportation of operating personnel and equipment to and from the face. The movement of personnel and equipment must not interfere with the face ventilation. However, the construction of multiple entries, i.e. more than two, to the working face substantially adds to the cost of the longwall mining operation. Therefore, there is need for a longwall mining system that efficiently uses entryways for face ventilation and the movement of operating personnel and equipment.

SUMMARY OF THE INVENTION

In accordance with the present invention there is provided a method for developing a longwall mining panel comprising the steps of advancing a continuous mining machine into a mine face to form an entryway of a preselected length and width. The entryway is divided rearwardly of the mining machine into a pair of parallel passageways by a barrier. A flow of air is introduced toward the mine face through one passageway as an intake air passageway to ventilate the mine face. Dust laden air is moved away from the mine face to the other passageway as a return air passageway. Conveying means is positioned in the return air passageway rearwardly of the mining machine. The material dislodged from the mine face is removed by the mining machine by depositing the material onto the conveying means. The dislodged material is transported rearwardly from the mine face on the conveying means in the return air passageway.

Further in accordance with the present invention there is provided a longwall mining system for extracting mine material from an underground formation that includes a panel of mine material formed in the underground formation. The panel is defined by a working face and a pair of entryways extending substantially perpendicular to the working face. Dislodging means extracts mine material from the working face. The entryways extend from the working face in spaced relationship with the panel therebetween. Means is positioned in the entryways for dividing each entryway into a pair of parallel passageways. One of the passageways forms an intake air passageway and the other passageway forms a return air passageway. Ventilating means directs air flow through the intake air passageway to the working face as mine material is dislodged therefrom. Exhaust means directs air flow through the return air passageway from the working face to establish a continuous flow of air through the intake air passageway and the return air passageway to ventilate the working face. Means is positioned in the return air passageway for conveying out of the entryway material extracted by the dislodging means.

Additionally, the present invention is directed to a method for developing an underground mining panel using a continuous mining machine that includes the steps of advancing a mining machine into a seam of material to be mined as the mining machine dislodges the mine material to form a first entryway into the seam. The mining machine is turned at substantially a right angle to the first entryway at a working face of the mine seam. The mining machine is advanced into the working face to dislodge the mine material to form a first cross entryway extending perpendicular to the first entryway. The mining machine is turned at substantially a right angle to the cross entryway a preselected distance from the first entryway. The mining machine is advanced into the working face in a direction opposite to the direction of machine advance in the first entryway to form a second entryway parallel to the first entryway. The mining machine is advanced to dislodge the mine material to extend the second entryway a preselected distance into the mine seam perpendicular to the first cross entryway. The mining machine is turned at substantially a right angle to the second entryway toward the first entryway. The mining machine is advanced to dislodge the mine material to form a second cross entryway parallel to the first cross entryway. The second cross entryway is driven to intersect the first entryway such that a rectangular panel of material to be mined is formed by the first entryway, the first cross entryway, the second entryway, and the second cross entryway. All of the entryways forming the panel are divided into an intake air passageway and a return air passageway. A flow of air is conveyed into the intake air passageway to the working face. Airborne particulate matter entrained in the flow of air is conveyed away from the working face through the return air passageway.

Accordingly, the principal object of the present invention is to provide a single entry longwall mining system that reduces the expenses associated with the development of conventional longwall mining systems.

Another object of the present invention is to provide a method for developing a longwall panel by a series of intersecting single entryways cut into the mine seam by a continuous mining machine.

A further object of the present invention is to provide a method for forming an entryway in a mine seam of an underground mine by dislodging the mine material using a continuous mining machine to drive entryways in a pattern forming a rectangular panel to be dislodged by a longwall mining operation where the single entry forming the panel is divided into a pair of parallel passageways through which intake air is supplied to the working face and return air containing airborne particulate matter is conveyed away from the working face to provide ventilation at the working face during the mining operation.

These and other objects of the present invention will be more completely disclosed and described in the following specification, the accompanying drawings and the appended claims.

DESCRIPTION OF THE PREFERRED EMBODIMENTS

Figure 1:
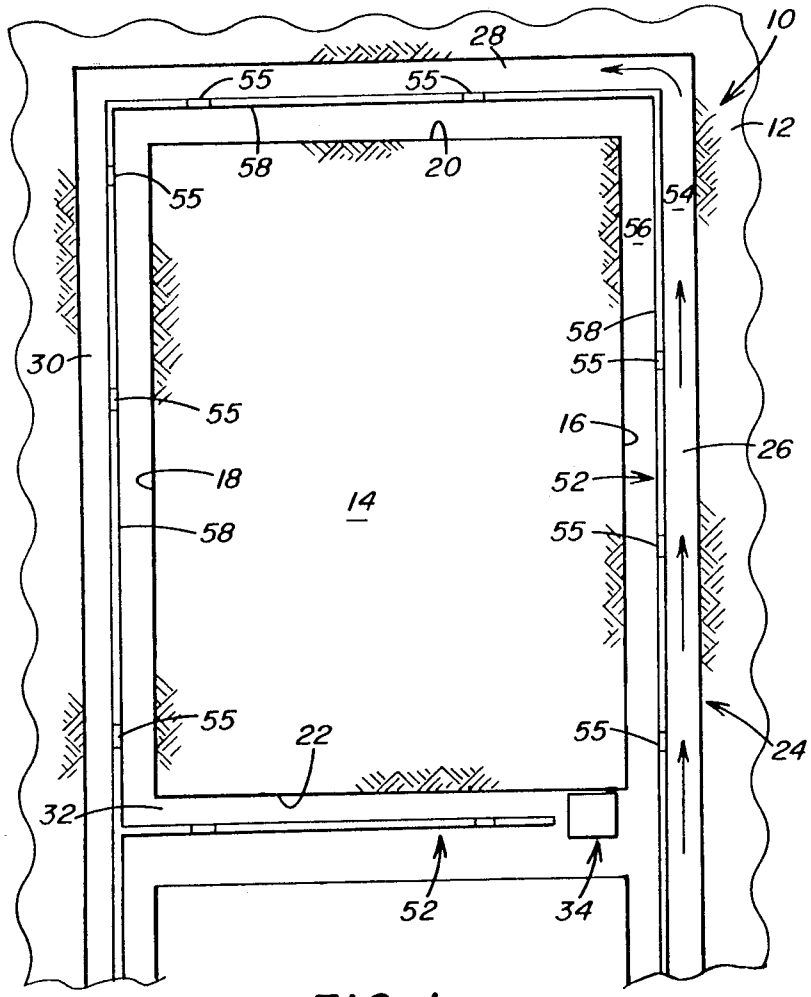
FIG. 1 is a schematic plan view of an underground mine, illustrating a panel cut in a seam of material to be mined by a continuous mining machine and to be removed by a longwall mining operation.

Referring to the drawings and particularly to FIG. 1, there is illustrated an underground mine generally designated by the numeral 10 for extracting material from an underground deposit 12. In accordance with the present invention, the mine material is extracted by the formation of a panel 14 of material to be mined. The panel 14 as shown in FIG. 1 is approximately rectangular in configuration formed by a pair of longitudinal walls 16 and 18 and a pair of transverse walls 20 and 22. The panel 14 is developed in the seam of the deposit 12 by cutting a single entryway generally designated by the numeral 24 in a rectangular configuration that includes a first entryway 26 forming a longitudinal wall 16, a cross entryway 28 forming the transverse wall 20, a second entryway 30 forming the longitudinal wall 18, and a second cross entryway 32 forming the transverse wall 22. Thus, the single entryway 24 directed through the seam of material to be mined includes the entryways 26, 28, 30 and 32 extending in right angle relationship to each other so as to form the rectangular panel or block 14 of mine material to be extracted by a longwall mining system. In the alternative, rather than form the rectangular block 14 by entryways 26, 28, 30 and 32, only entryways 26 and 30 are formed with one or both of the cross entryways 28 and 32 deleted.

Once the panel 14 is developed, as will be described later in greater detail, the panel 14 is extracted from the underground deposit 12 to be mined by a longwall mining system. The longwall mining system is positioned in one of the cross entryways 28 or 32. The transverse walls 20 and 22 of the panel 14 form a working face from which the material comprising the panel 14 is extracted. The working face is thus formed between the first and second entryways 26 and 30.

The longwall mining operation can be performed at the working face formed by the transverse wall 22 in the advancing method or at the working face forming the transverse wall 20 in the retreating method. In the longwall advancing method the working face is mined traversing the face beginning at the wall 22 between the first and second entryways 26 and 30. The mined material is sheared from the face which advances through the panel toward the end of the panel at the transverse wall 20. Longwall mining systems are well known in the art and include a shearer which repeatedly traverses the working face. For example, a shearer transverses wall 22 toward the transverse wall 20 in the advancing method. Conversely, in the longwall retreating method, the method of mining is the same except the mining starts from the working face formed by the transverse wall 20. The working face retreats in the reverse direction toward the transverse wall 22. The basic longwall mining system includes a shearer which acts to cut into the working face and shear off the material as it moves across the entire length of the working face. The dislodged mine material is deposited onto a conveyor that is positioned beneath the shearer. The dislodged material is transported by the conveyor to the lateral passageways 26 or 30 where the material is transferred onto an extensible conveyor for removal out of the mine. The details of the longwall mining system are beyond the scope of the present invention and therefore, will not be described in detail herein.

In order to efficiently develop the panel 14 in the rock formation comprising the material to be extracted, a mining machine cuts through the underground deposit 12 to form the single entryway 26 that extends in the rectangular configuration shown in FIG. 1 to form the panel 14. Preferably, the single entryway 26 is developed by a continuous mining machine. Most preferably, the type of continuous mining machine used to develop the single entryway 26 is a boring type mining machine as disclosed in U.S. Pat. No. 4,339,153 entitled "Apparatus For Extending And Retracting The Cutter Bars Of A Boring Type Mining Machine", issued Jul. 13, 1982, which is incorporated herein by reference. It should be understood, however, that other types of continuous mining machines and in particular, boring type mining machines are suitable for use in cutting the single entryway 26 which forms the panel 14 in the underground deposit 12.

Figure 2:
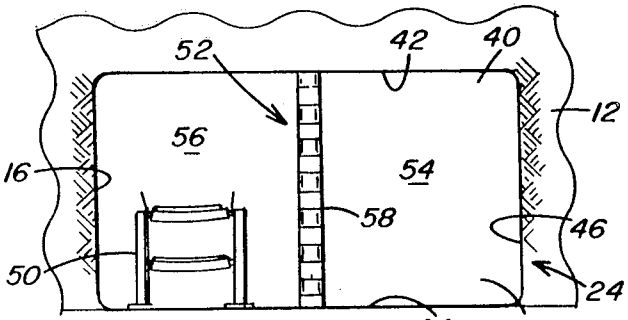
FIG. 2 is a schematic view in side elevation of an entryway formed in the seam as shown in FIG. 1, illustrating a mine stopping for dividing the entryway into a pair of passageways to facilitate the flow of ventilation air to and from the working face and the positioning of equipment in the entryway to convey dislodged material from the working face.
Figure 3:
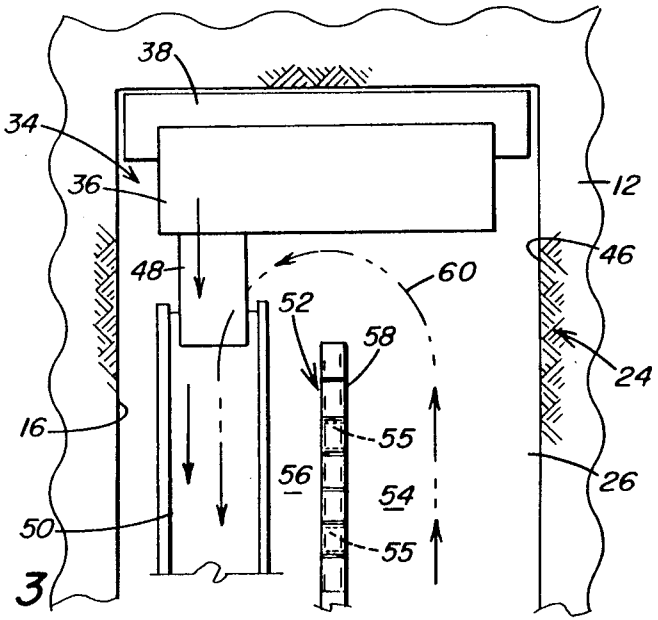
FIG. 3 is a schematic, fragmentary plan view of an entryway formed in the seam of an underground mine, illustrating a continuous mining machine for forming the entryway and the positioning of mine stopping rearwardly of the advancing mining machine to facilitate ventilation of the working face during the dislodging operation.

Referring to FIG. 3, there is schematically illustrated a continuous mining machine generally designated by the numeral 34, representative of the above-identified boring type of mining machine, for forming the single entryway 24 defining the panel 14. The continuous mining machine 34 and specifically a boring type mining machine includes a mobile frame 36 mounted for movement on a propelling mechanism (not shown) such as crawler tracks in a manner well known in the art. A rotary cutting device 38 includes a pair of boring heads rotatably mounted on the front end of the mobile frame 36 and driven to cut an opening 40 in the seam of the deposit 12, as shown in FIG. 2. The opening 40 is substantially rectangular in configuration as schematically illustrated in FIG. 2, defining a mine roof 42 and a mine floor 44 between side walls or ribs 16 and 46.

The mining machine 34 is forwardly advanced into the working face to dislodge the mine material. Continued advance of the mining machine 34 develops the single entryway 26 defined by the mine roof 42 and floor 44 and ribs 16 and 46. The ribs 16 and 46 have a preselected height as determined by the thickness of the seam of material to be extracted from the underground deposit 12.

The mining machine 34 initiates the dislodging operation to form the first entryway 26 of the rectangular single entryway 24. As the mining machine 34 advances forwardly into the working face, the dislodged material is gathered adjacent the working face and conveyed rearwardly on the mining machine frame 36 by a rearwardly extending conveyor 48. From the mining machine conveyor 48, the material is discharged onto another suitable conveying device, such as an extensible conveyor which has an end portion positioned in underlying relation with the mining machine conveyor 48. A suitable conveying device for use in combination with the mining machine conveyor 48 to transport the dislodged material away from the working face is an extensible mobile belt conveyor 50. The belt conveyor 50 is conventional in design and is schematically illustrated in FIG. 2.

To facilitate the efficient transportation of dislodged material out of the underground mine 10 and provide ventilation of the working face, the single entryway 24 is divided by a stopping device generally designated by the numeral 52 into a pair of parallel passageways 54 and 56 as indicated in FIG. 2. The stopping 52 is secured to the mine roof 42 and mine floor 44 and extends therebetween dividing the single entryway 24 into the two passageways 54 and 56.

In one embodiment, the stopping device 52 is a brattice cloth or line curtain formed of cloth material or the like. In another embodiment, the stopping device 52 is formed of material more rigid than cloth, such as brick or block. When a brick or block stopping device 52 is utilized to divide the entryway 24 into separate passageways 54 and 56, it also serves as a mine roof support. Preferably, the brick or block stopping 52 includes at spaced apart intervals along the length thereof openings 55, schematically illustrated in FIGS. 1 and 3, to provide access to one passageway from the other. The openings 55 are closed by a movable brattice cloth or line curtain (not shown).

The stopping 52 is progressively constructed and advances in the entryway 24 with the advancing mining machine 34. Preferably, the stopping 52 is maintained within 10 feet from the mine working face. In the instance of a line curtain-type stopping device 52, the line curtain is connected to mining machine 34 and extends from the rear of the mining machine as the mining machine advances forwardly in the entryway 24.

As seen in FIG. 3, the mine stopping 52 divides the first longitudinal entryway 26 into a pair of passageways 54 and 56. The passageway 54 forms an intake air passageway, and the passageway 56 forms a return air passageway. With this arrangement, the working face is ventilated with a supply of fresh air which is directed through the intake air passageway 54 toward the working face. At the mine face, the air is mixed with the airborne particulates that are generated during the dislodging operation. The airborne particulates are entrained in the air which flows from the working face rearwardly away from the face through the return air passageway 56. From the return air passageway 56, the dust entrained air is removed from the entryway 26 as it is being formed. In this manner, the working face is constantly ventilated by the supply of fresh air to the working face and the removal of airborne particulate matter, as indicated by the directional arrow 60 shown in FIG. 3.

Preferably, so as to not to interfere with the flow of fresh air to the working face, the intake air passageway 54 is maintained substantially free of mining equipment. However, the passageway 54 is conveniently available for the movement of equipment and supplies to the working face with the conveying device maintained in the passageway 56. The mining equipment and most particularly, the conveying devices such as the mining machine conveyor 48 and the belt conveyor 50 are maintained in the return air passageway 56. This is preferred so that the dust generated by the conveyance of dislodged material from the working face is also entrained with the air flow away from the face through the passageway 56. Access to the return air passageways 56 from the intake air passageway 54 for performing maintenance on the equipment in the passageway 56 is available through the openings 55 in the stopping device 52.

As illustrated in FIG. 3, the mining machine conveyor 48 is offset from the center line of the mining machine 34 so as to be aligned with the return air passageway 56. Conventionally, the longitudinal discharge conveyor of a continuous mining machine is centered on the machine and extends rearwardly therefrom. However, with the present invention the mining machine conveyor 48 and the auxiliary haulage belts used therewith are positioned on the mining machine frame 36 offset from the frame longitudinal center line. In this manner, the conveyor 48 is aligned with the return air passageway 56.

Further, in accordance with the present invention the mining machine 34 also includes roof bolting devices mounted thereon. The roof bolting devices are operable to install suitable mine roof supports in the mine roof 42 as the material dislodging operation is performed. In this manner, the mine roof is supported closely adjacent to the working face. Roof support devices are not shown in the schematic illustration of the mining machine in FIG. 3, but it should be understood that conventional roof bolters used on continuous mining machines are suitable for use with the present invention.

The longwall panel 14 illustrated in FIG. 1 is developed by initiating the driving of the single entryway 24 by advancing the mining machine 34 into a seam of mine material, a preselected distance to form the first entryway 26. The length of the first entryway 26 is selective, for example 150 feet. The width of the entryway 26 defined by the side ribs 16 and 46, as shown in FIG. 2, is a sufficient distance to provide an adequate working area within the separate passageways 54 and 56 for the passage of operating personnel and supplies through the passageway 54 to the working face and the conveyance of the dislodged material in the passageway 56.

The mining machine 34 drives the first entryway 26 a desired distance into the seam of material to be mined. When the mining machine has completed the length of the first entryway 26, it initiates a substantially right angle turn to drive a first cross entryway 28 substantially perpendicular to the first entryway 26. The length of the cross entryway 28 is also selective as required to form the working face for the longwall mining operation as defined by the transverse wall 20. The cross section of the entryway 28, as well as the entryways 30 and 32, corresponds to the cross section of the entryway 26 shown in FIG. 2.

Once the required length of the cross entryway 20 is developed the mining machine 34 again initiates a right angle turn to progress in a direction opposite to the direction of advance in the development of the first entryway 26. The mining machine advances through the working face to develop the second entryway 30. As the material is dislodged from the working face in the development of the entryway 30, the dislodged material is conveyed rearwardly through the cross entryway 28 and the first entryway 26 out of the underground mine 10.

The mining machine 34 continues to advance in the development of the second entryway 30 a distance so that the length of the entryway 30 corresponds to the length of the entryway 26. When the entryway 30 is completed, the mining machine 34 again executes another right angle turn toward the first entryway 26 to form a second cross entryway 32 which is parallel to the first cross entryway 28. The cross entryway 32 is developed until it intersects the first entryway 26 The panel 14 is defined by the longitudinal walls 16 and 18 and the transverse walls 20 and 22 which form the working faces in the extraction of the material by the longwall mining operation, as above-described. Where desired entryways 26 and 30 can be formed at the same time by a pair of mining machines. A preselected one of the mining machines forms the transverse entryways or crosscuts.

Thus with the present invention, the continuous mining machine 34 is efficiently used to form a longwall panel 14 by a single entryway 26 cut in a rectangular configuration. This avoids the necessity of cutting multiple entries into the panel 14 to facilitate ventilation in the extraction process. By dividing the entryways 26, 28, 30 and 32 into the pair of passageways 54 and 56 by the mine stopping 52, fresh air is conveyed to the working face and particulate laden air is conveyed away from the working face. Thus, the working face is constantly and efficiently ventilated.

According to the provisions of the patent statutes, I have explained the principle, preferred construction, and mode of operation of my invention and have illustrated and described what I consider to represent its best embodiments. However, it should be understood that, within scope of the appended claims, the invention may be practiced otherwise than as specifically illustrated and described.

I claim:

1. A method for developing a longwall mining panel comprising the steps of, advancing a continuous mining machine into a mine face to dislodge material and form a first entry way of a preselected length and width, dividing the first entryway rearwardly of the mining machine into a pair of parallel passageways by a barrier as the mining machine advances, introducing a flow of air toward the mine face through one passageway as an intake air passageway to ventilate the mine face during the material dislodging operation, moving dust laden air away from the mine face through the other passageway as a return air passageway, positioning conveying means in the return air passageway rearwardly of the mining machine, removing material dislodged from the mine face by the mining machine by depositing the material onto the conveying means, transporting the dislodged material rearwardly from the mine face on the conveying means in the return air passageway, turning the mining machine in a preselected direction to change the direction of travel of the mining machine to form a second entryway extending from the first entryway, dividing the second entryway behind the advancing mining machine into intake and return air passageways extending from the passageways in the first entryway for continuous ventilation of the second entryway as it is being developed, and advancing the second entryway a preselected distance and simultaneously ventilating the first and second entryways divided into intake and return air passageways.

2. A method as set forth in claim 1 which includes, continuously advancing the mine face in the formation of a continuous, single entryway by the forward advance of the mining machine along a preselected path circumscribing a panel of material to be mined.

3. A method as set forth in claim 1 which includes, installing roof bolts in the roof of the entryway as the entryway is being formed.

4. A method as set forth in claim 1 which includes, positioning the conveying means on the mining machine in alignment with the return air passageway of the entryway.

5. A method as set forth in claim 1 which includes, advancing the barrier with the mining machine to maintain the intake air passageway and the return air passageway closely adjacent the mine face.

6. A method as set forth in claim 5 which includes, constructing the barrier of cloth material to extend between a roof and floor of the entryway.

7. A method as set forth in claim 5 which includes, constructing the barrier of block material to extend between a roof and floor of the entryway.

8. A method as set forth in claim 1 which includes, positioning a panel conveyor belt in the return air passageway.

9. A method as set forth in claim 8 which includes, positioning an extensible conveyor traversing the entryway between the mining machine and the panel conveyor belt, discharging mined material onto the extensible conveyor from the mining machine, and discharging the mined material from the extensible conveyor onto the panel conveyor for said removal at a point remote from the mine face.

10. A method as set forth in claim 1 which includes, continuing to turn the mining machine to change the direction of travel of the mining machine to form a subsequent entryway connected to the first and second entryways in the formation of a panel of material to be mined.

11. A method as set forth in claim 10 which includes, continuing to advance the mining machine in the subsequent entryway in a direction leading back to the point of origination of the first entryway to circumscribe the panel.

12. A method as set forth in claim 11 which includes, ventilating the panel defined by a continuous, single entryway circumscribing the panel and divided into intake and return air passageways.

13. A longwall mining system for extracting mineral material from an underground formation comprising, a panel of mine material defined by a single entryway formed by a plurality of intersecting entryways circumscribing said panel in the underground formation, said panel including a working face and a pair of said entryways extending substantially perpendicular to said working face, dislodging means for extracting mine material from said working face, said entryways extending from said working face in spaced parallel relationship with said panel therebetween, means extending through said plurality of intersecting entryways for dividing said single entryway circumscribing said panel into a pair of parallel passageways, one of said passageways forming an intake air passageway and the other of said passageways forming a return air passageway, ventilating means for directing air flow through said intake air passageway to said working face as mine material is being dislodged therefrom, exhaust means for directing air flow through said return air passageway from said working face to establish a continuous flow of air circulating through said intake air passageway and said return air passageway around said panel to ventilate said working face, said dislodging means positioned in said return air passageway with said intake air passageway remaining open for the movement of equipment and supplies to said working face, and means positioned in said return air passageway rearwardly of said dislodging means for conveying out of said entryway material extracted by said dislodging means.

14. A method for developing an underground mining panel using a continuous mining machine comprising the steps of, advancing a mining machine into a mine sam of material to be mined as the mining machine dislodges the material to form a first entryway into the mineral seam, turning the mining machine at substantially a right angle to the first entryway at a working face of the seam, advancing the mining machine into the working face to dislodge material from the seam to form a first cross entryway perpendicular to the first entryway, turning the mining machine at substantially a right angle to the cross entryway a preselected distance from the first entryway, advancing the mining machine into the working face in a direction opposite to the direction of machine advance in the first entryway to form a second entryway parallel to the first entryway, advancing the mining machine to dislodge material from the seam to extend the second entryway a preselected distance into the seam perpendicular to the first cross entryway, turning the mining machine at substantially a right angle to the second entryway toward the first entryway, advancing the mining machine to dislodge material from the seam to form a second cross entryway parallel to the first cross entryway, driving the second cross entryway to intersect the first entryway such that a rectangular panel of material to be mined is formed by the first entryway, the first cross entryway, the second entryway, and the second cross entryway, dividing all of the entryways forming the panel into an intake air passageway and a return air passageway, conveying a flow of air into the intake air passageway to the working face, and conveying airborne particulate material entrained in the flow of air away from the working face through the return air passageway.

* * * * *